US009327865B2

(12) United States Patent
Given

(10) Patent No.: US 9,327,865 B2
(45) Date of Patent: May 3, 2016

(54) METHOD OF PROTECTING OBJECTS USING FRICTION-LOCK ADAPTABLE SPACERS

(71) Applicant: Pacific Market International, LLC, Seattle, WA (US)

(72) Inventor: Austin M. Given, Bremerton, WA (US)

(73) Assignee: PACIFIC MARKET INTERNATIONAL, LLC, Seattle, WA (US)

( * ) Notice: Subject to any disclaimer, the term of this patent is extended or adjusted under 35 U.S.C. 154(b) by 467 days.

(21) Appl. No.: 13/853,664

(22) Filed: Mar. 29, 2013

(65) Prior Publication Data

US 2014/0124569 A1 May 8, 2014

Related U.S. Application Data

(63) Continuation of application No. 13/020,113, filed on Feb. 3, 2011, now Pat. No. 8,430,250.

(51) Int. Cl.

*B65B 17/02* (2006.01)
*B65D 5/50* (2006.01)
*B65B 11/00* (2006.01)

(Continued)

(52) U.S. Cl.

CPC ..... *B65D 5/504* (2013.01); *B31D 5/0017* (2013.01); *B65B 11/004* (2013.01); *B65B 17/02* (2013.01); *B65B 43/10* (2013.01); *B65D 5/0095* (2013.01); *B65D 5/5035* (2013.01); *B65D 5/5038* (2013.01); *B65D 5/5069* (2013.01); *B65D 5/526* (2013.01); *B65D 71/403* (2013.01)

(58) Field of Classification Search

CPC ..... B65B 11/004; B65B 15/00; B65B 17/02; B65B 43/08; B65B 43/10; B65D 5/0095; B65D 5/5038; B65D 5/504; B65D 5/5052; B65D 5/5059; B65D 5/5064; B65D 5/5069; B65D 5/5071; B65D 5/5073; B65D 5/508; B65D 5/5083; B65D 71/403; B65D 71/70; B65D 71/72

USPC ..... 53/397, 398, 456; 206/199

See application file for complete search history.

(56) References Cited

U.S. PATENT DOCUMENTS 2,314,491 A * 3/1943 Greenberg ..... B65D 5/504 206/587
2,339,176 A * 1/1944 Lee ..... B65D 5/5038 206/427

(Continued)

FOREIGN PATENT DOCUMENTS

CH 289864 A * 3/1953 ..... B65D 5/504
DE 202006013260 10/2006

(Continued)

*Primary Examiner* — Stephen F Gerrity

(74) *Attorney, Agent, or Firm* — George C. Rondeau, Jr.; Davis Wright Tremaine LLP

(57) ABSTRACT

A friction lock adaptable spacer configured to provide suitable separation between two or more objects. The spacer may be used during the storage, transport, display, and/or use of the objects to separate them and protect them from their surrounding environment. In some embodiments, the spacer is designed to maintain a suitable separation between two or more beverage containers. The spacer has a single piece construction, which reduces assembly and disassembly labor, and also reduces materials required for construction and disposal. The spacer may be constructed from a single piece of material, such as corrugated cardboard.

1 Claim, 11 Drawing Sheets

(51) Int. Cl.

| | |
|---|---|
| ***B65D 5/00*** | (2006.01) |
| ***B65D 71/40*** | (2006.01) |
| ***B65B 43/10*** | (2006.01) |
| ***B65D 5/52*** | (2006.01) |
| ***B31D 5/00*** | (2006.01) |

(56) References Cited

U.S. PATENT DOCUMENTS

| | | | | | |
|---|---|---|---|---|---|
| 2,368,753 | A | * | 2/1945 | Elliott et al. | B65D 5/5042 206/419 |
| 2,706,590 | A | * | 4/1955 | Bergstein | B65D 5/5042 206/429 |
| 2,866,588 | A | | 12/1958 | Bolding | |
| 2,943,780 | A | | 7/1960 | Bolding | |
| 3,069,004 | A | * | 12/1962 | Bolding | B65D 71/125 206/426 |
| 3,206,097 | A | | 9/1965 | Holmes | |
| 3,360,117 | A | | 12/1967 | Powers et al. | |
| 3,366,232 | A | * | 1/1968 | Elfstrom et al. | B65D 5/5042 206/315.11 |
| 3,406,819 | A | * | 10/1968 | Brander | B65D 5/5035 206/422 |
| 3,414,182 | A | | 12/1968 | Fobiano | |
| 3,917,158 | A | | 11/1975 | Dorofachuk et al. | |
| 3,983,680 | A | * | 10/1976 | Casutt | B65B 23/02 53/397 |
| 4,187,976 | A | | 2/1980 | Mather | |
| 4,450,965 | A | * | 5/1984 | Paillet | B65D 5/504 206/443 |
| 4,526,315 | A | | 7/1985 | Muise | |
| 4,905,820 | A | | 3/1990 | Hart et al. | |
| 5,275,331 | A | | 1/1994 | Chung-Piao | |
| 5,381,948 | A | | 1/1995 | Coalier et al. | |
| 5,458,237 | A | * | 10/1995 | Kataoka | B65D 5/504 206/449 |
| 5,595,047 | A | * | 1/1997 | Paumen et al. | B65D 71/16 206/705 |
| 5,595,292 | A | | 1/1997 | Bates | |
| 5,829,587 | A | * | 11/1998 | Saiki et al. | B65D 5/504 206/327 |
| 6,199,700 | B1 | | 3/2001 | Yamamoto et al. | |
| 6,474,473 | B2 | | 11/2002 | Wong | |
| 6,675,969 | B1 | | 1/2004 | Kiyohara et al. | |
| 2003/0226784 | A1 | | 12/2003 | Petner et al. | |
| 2006/0000879 | A1 | | 1/2006 | Madec | |
| 2007/0209964 | A1 | * | 9/2007 | Chen | B65D 5/504 206/586 |
| 2007/0215509 | A1 | * | 9/2007 | Moses | B65D 5/5052 206/485 |
| 2008/0093432 | A1 | | 4/2008 | Moenne-Loccoz et al. | |
| 2009/0084833 | A1 | | 4/2009 | Keefe, Jr. et al. | |

FOREIGN PATENT DOCUMENTS

| | | | | | |
|---|---|---|---|---|---|
| EP | 0103535 | | | 3/1984 | |
| EP | 0436968 | | | 7/1991 | |
| FR | 1237312 | A | * | 7/1960 | B65D 5/504 |
| FR | 1317360 | A | * | 2/1963 | B65D 5/38 |
| FR | 2776630 | A1 | * | 10/1999 | B65D 5/5059 |
| FR | 2796365 | A1 | * | 1/2001 | B65D 5/5059 |
| FR | 2885881 | | | 11/2008 | |
| GB | 701212 | | | 12/1953 | |
| GB | 785227 | | | 10/1957 | |
| GB | 844524 | | | 8/1960 | |
| GB | 1028498 | | | 5/1966 | |
| GB | 1080257 | A | * | 8/1967 | B65D 71/72 |
| GB | 1503507 | | | 5/1978 | |

* cited by examiner

METHOD OF PROTECTING OBJECTS USING FRICTION-LOCK ADAPTABLE SPACERS

CROSS REFERENCE TO RELATED APPLICATION(S)

This application is a continuation of U.S. application Ser. No. 13/020,113 filed Feb. 3, 2011, now U.S. Pat. No. 8,430, 250 the contents of which are incorporated by reference herein.

BACKGROUND OF THE INVENTION

1. Field of the Invention

The present invention is directed generally to product packaging and more particularly to spacers for separating and protecting products during transport, storage, display, or use.

2. Description of the Related Art

The use of corrugated cardboard boxes as shipping and storage containers is well-known. These boxes may be used to transport various goods from the manufacturer to the distributor, and also to store these goods prior to display and sale. Some boxes may also be suitable for retail display purposes. For some products, it is desirable to include devices that operate to separate and protect the products from coming into contact with each other or with other objects. These devices may generally be referred to as "spacers." Spacers may be used during transport, storage, display, and/or use of these products.

DETAILED DESCRIPTION OF THE INVENTION

The present invention is directed to various embodiments of friction-lock adaptable spacers configured to hold and provide suitable separation between two or more objects. The spacers may be used during the storage, transport, display, and/or use of the objects to separate them and to protect them from their surrounding environment. In exemplary embodiments, the spacers are designed to maintain a suitable separation between two or more beverage containers, although the concepts disclosed herein may have a wide variety of applications. The spacers of the present invention have a single piece construction, which reduces assembly and disassembly labor, and also reduces materials required for construction and disposal.

Figure 1:
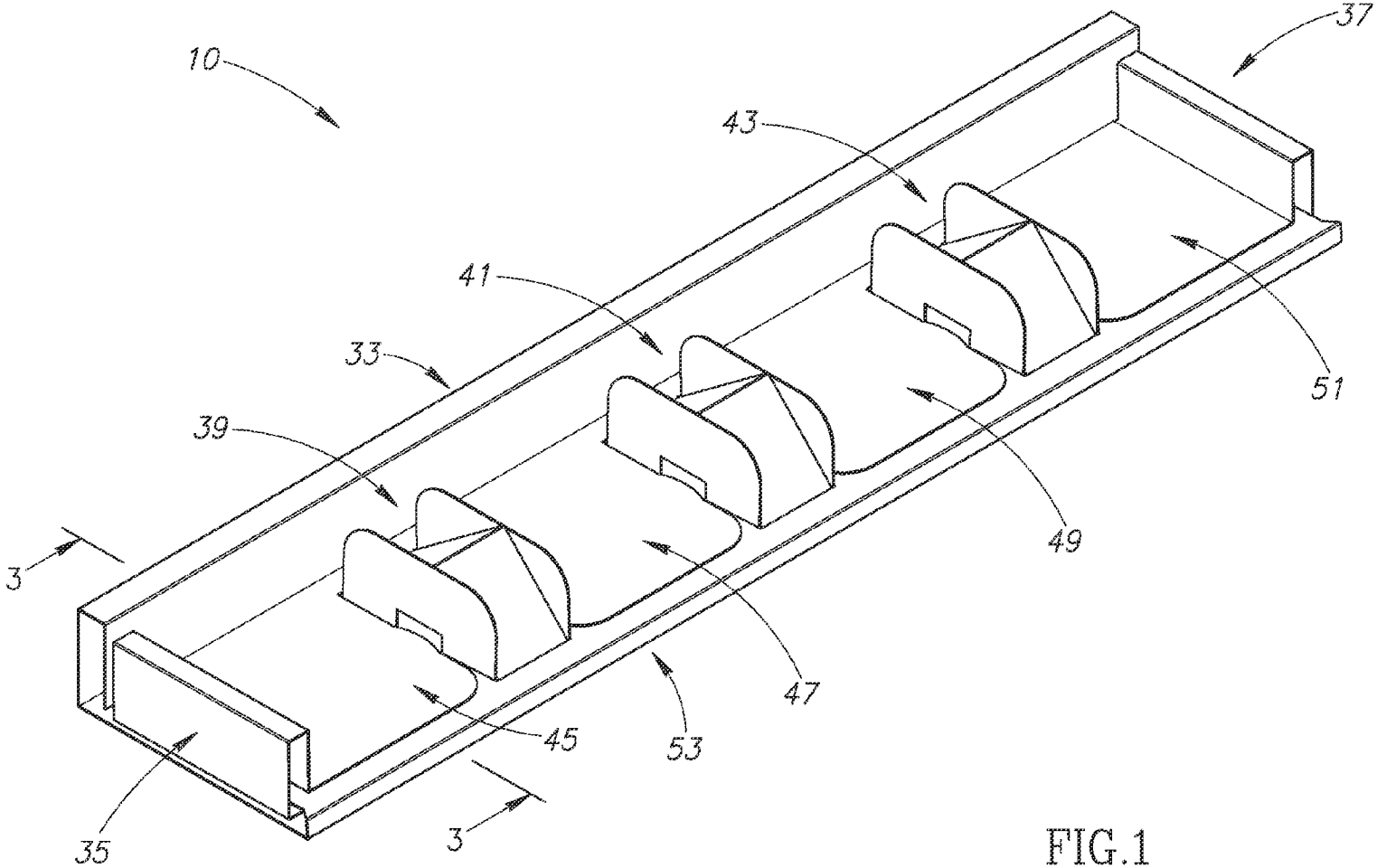
FIG. 1 is a perspective view of a friction-lock spacer in accordance with an embodiment of the present invention.

FIG. 1 illustrates an assembled friction-lock adaptable spacer 10 in accordance with an embodiment of the present invention. The spacer 10 comprises a rectangular base portion 53, a left sidewall portion 35 extending upwardly from a left side of the base portion, a right sidewall portion 37 extending upwardly from a right side of the base portion, and a backstop portion 33 extending upwardly from a rear side of the base portion. The spacer 10 also comprises three separator portions 39, 41, and 43 that each extend upwardly from the base portion 53. While three separator portions are illustrated, the spacer may be constructed with fewer or more separator portions.

Figure 3:
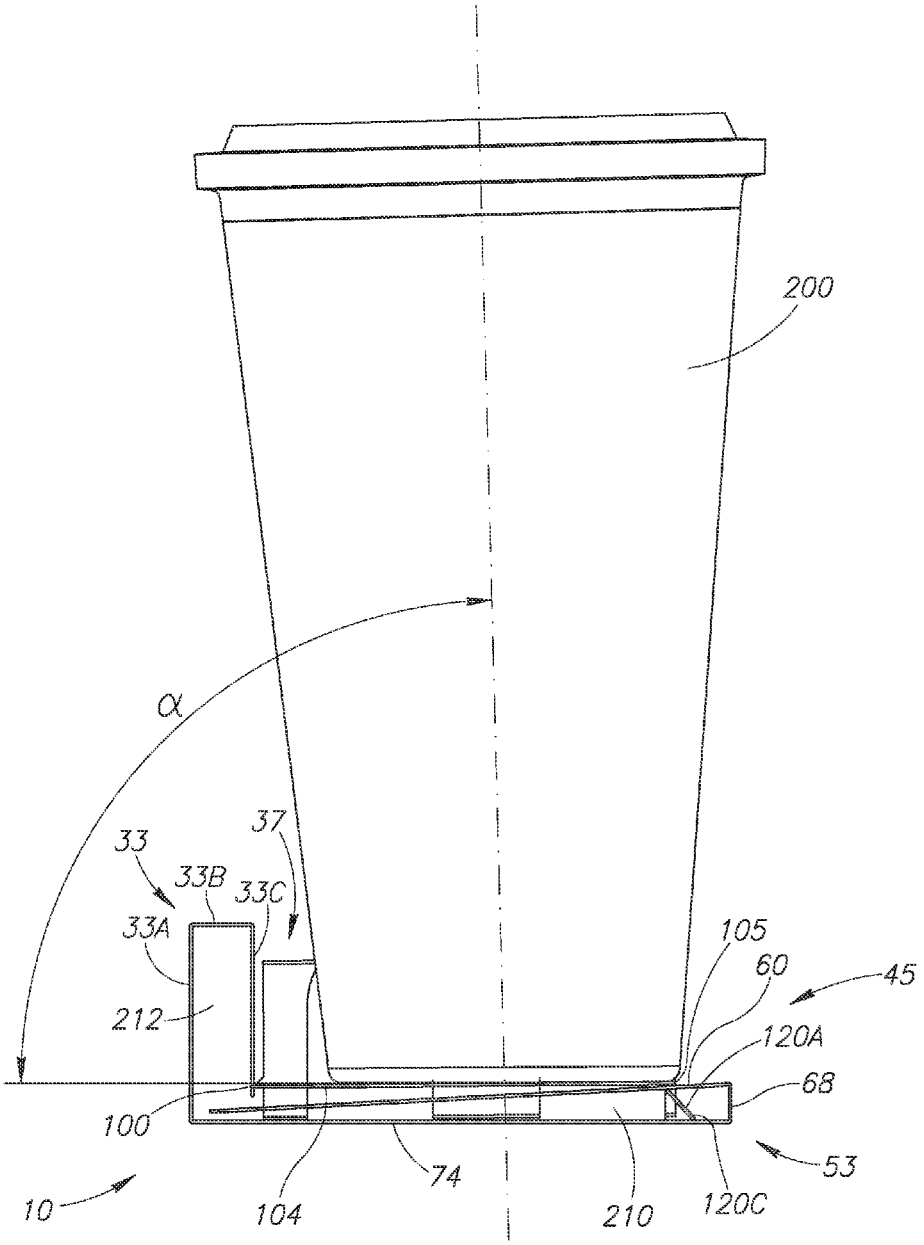
FIG. 3 illustrates a left side cross-sectional view of the friction-lock spacer taken substantially along the line 3-3 of FIG. 1.

The aforementioned components of the spacer 10 are configured to define a row of four slots or channels 45, 47, 49, and 51, each sized to receive a portion of an object, such as the lower portion of a beverage container (see FIG. 3). Each of the channels 45, 47, 49, and 51 is defined on the bottom by the base portion 53 and on the rear by the backstop portion 33. The channel 45 is defined on the left side by the left sidewall 35 and on the right side by the separator portion 39. The channel 47 is defined on the left side by the separator portion 39 and on the right side by the separator portion 41. The channel 49 is defined on the left side by the separator portion 41 and on the right side by the separator portion 43. The channel 51 is defined on the left side by the separator portion 43 and on the right side by the right sidewall 37. The front portion of each of the channels 45, 47, 49, and 51 does not include an upright raised portion, thereby forming an unobstructed forwardly open end passageway so that an object may be inserted into and removed from each of the channels by the generally horizontal movement of the objects (i.e., without requiring substantial vertical displacement). The operation of the spacer 10 is described in further detail below.

Figure 2A:
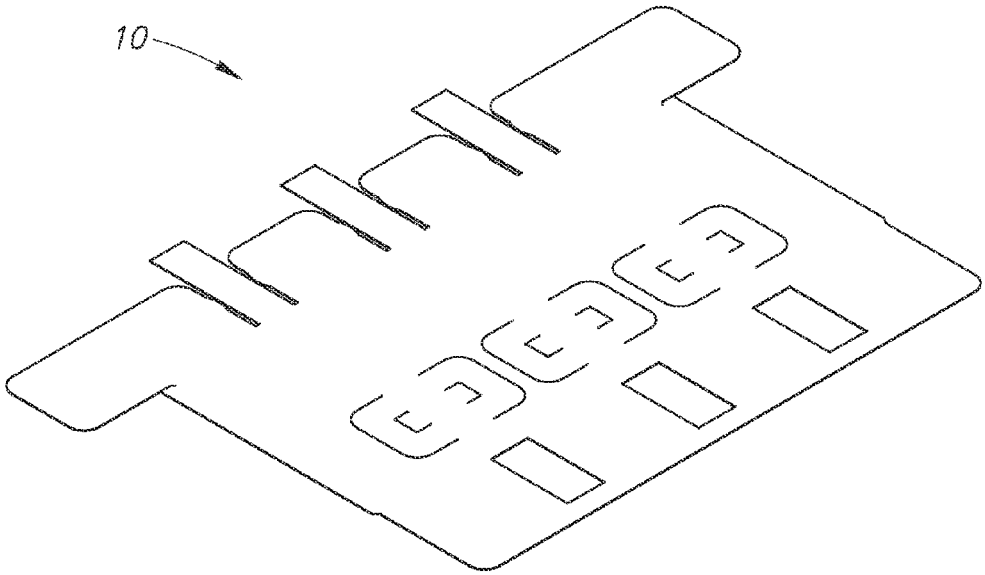
FIGS. 2A-2G illustrate various views of the friction-lock spacer shown in FIG. 1 during sequential steps of an assembly process.
Figure 6:
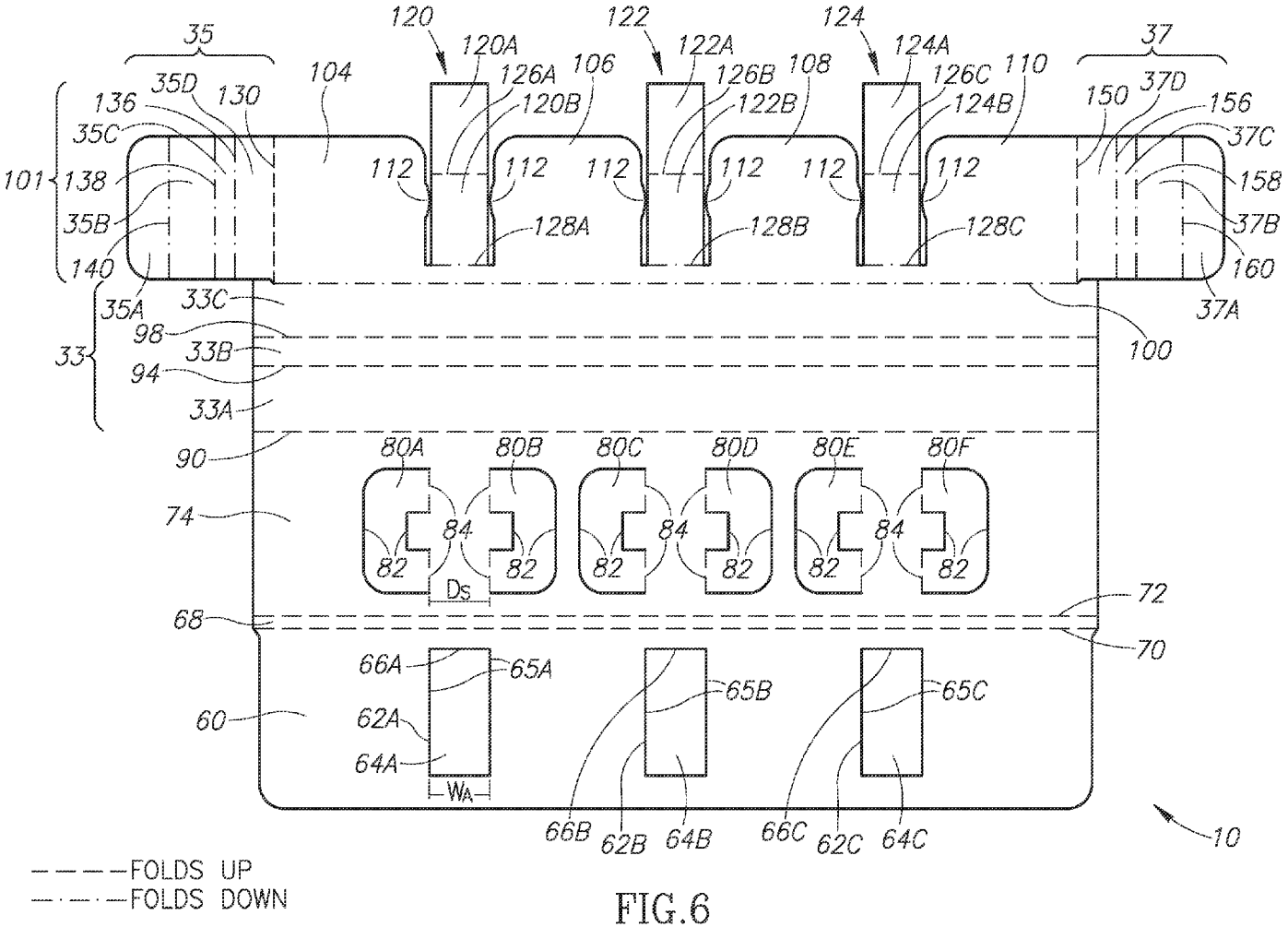
FIG. 6 is a top view of the friction-lock spacer shown in FIG. 1 when in a fully unassembled condition.

FIGS. 2A-2G illustrate a sequence of assembly steps for the spacer 10 shown in FIG. 1. As discussed above, the spacer 10 is formed from a single planar piece of material (a "blank") that comprises numerous sections or "panels" that may be folded along fold lines to form the shape of the spacer 10 shown in FIG. 1. The material may be a suitable paperboard or corrugated cardboard as known in the art. FIG. 2A shows the spacer 10 when in the fully unassembled condition. For reference purposes, FIG. 6 also shows a top view of the unassembled spacer 10 and includes reference numerals for each of the panels, fold lines (indicated by dashed lines or dash-dotted lines), and cut lines (indicated by solid lines) of the spacer. The blank that forms the spacer 10 may be scored on the fold lines to enable a user to easily fold the blank. The fold lines that separate two panels that are "folded up" out of the page as shown in FIG. 6 are indicated by dashed lines, and the fold lines that separate two panels that are "folded down" into the page are indicated by dash-dotted lines.

Figure 2B:
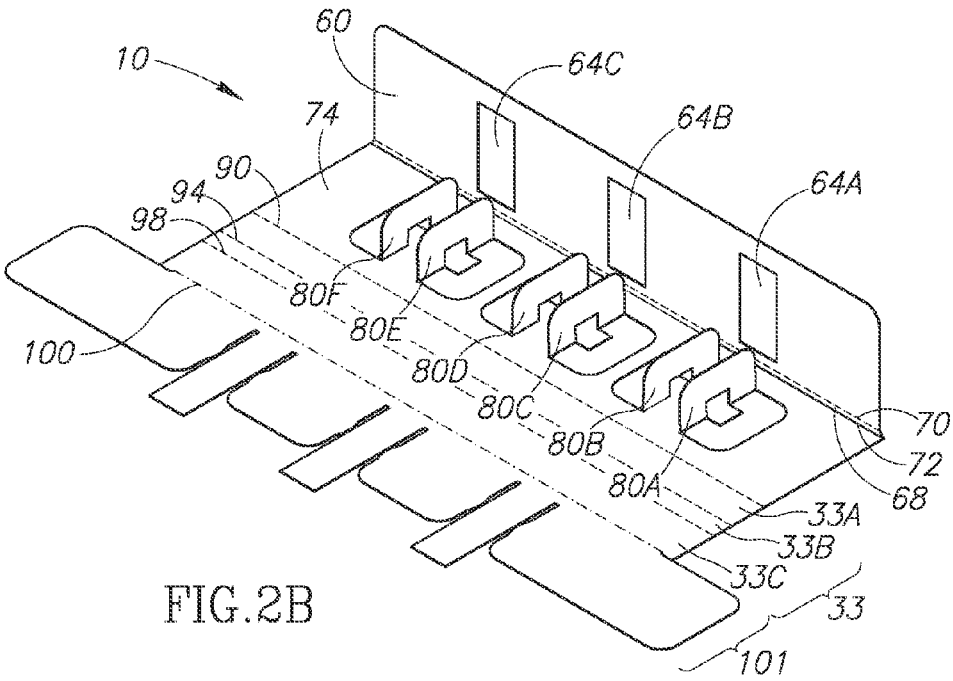
Figure 2C:
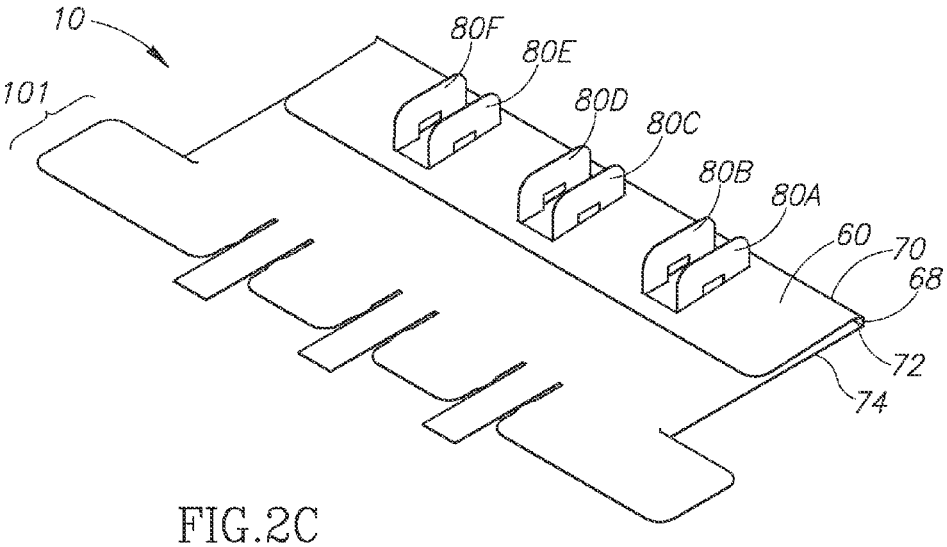

Referring to FIG. 2B, the spacer 10 includes a separation tabs panel 74 that includes six separation tabs 80A, 80B, 80C, 80D, 80E, and 80F (collectively referred to as separation tabs 80A-F). As may best be seen in FIG. 6, each of the separation tabs 80A-F is formed from the panel 74 by cut lines 82 in the panel. As shown in FIG. 2B, the separation tabs 80A-F are each folded in an upward direction at the fold lines 84 (shown in FIG. 6) into a substantially vertical position.

The spacer 10 also includes a panel 60 having three apertures 64A, 64B, and 64C disposed therein, each sized to receive two adjacent ones of the separation tabs 80A-F when the separation tabs are positioned in a vertical position. The panel 60 is coupled to the separation tabs panel 74 by a front panel 68. In the assembly step shown in FIG. 2B, the front panel 68 is folded upward relative to the panel 74 along a fold line 72. In the next assembly step, shown in FIG. 2C, the panel 60 is folded downward along the fold line 70 so that the panel 60 is positioned over the separation tabs panel 74, with the separation tabs 80A-F of the panel 74 extending upwardly through the apertures 64A-C of the panel 60 as the panel 60 is folded over the panel 74. More specifically, the pair of separation tabs 80A and 80B extend upwardly through the aperture 64A, the pair of separation tabs 80C and 80D extend upwardly through the aperture 64B, and the pair of separation tabs 80E and 80F extend upwardly through the aperture 64C. The width ($W_A$) of the apertures 64A-C may be configured to be approximately the same size as or slightly smaller than the distance ($D_S$) between each pair of separation tabs 80A-F (e.g., the distance between separation tabs 80A and 80B). In this regard, longitudinal sides 65A-C of the apertures 64A-C, respectively, may tend to exert a small inward force on the lower portions of the separation tabs 80A-F such that the two separation tabs of each pair of separation tabs are biased slightly inward toward each other. That is, the sides 65A of the aperture 64A may bias the separation tabs 80A and 80B toward each other, the sides 65B of the aperture 64B may bias the separation tabs 80C and 80D toward each other, and the sides 65C of the aperture 64C may bias the separation tabs 80E and 80F toward each other.

Figure 2D:
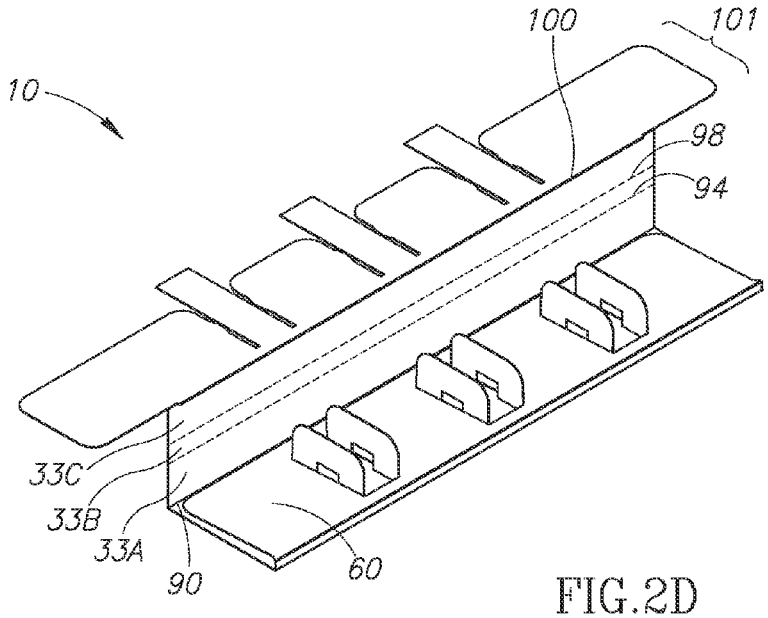

The next step of the assembly process is shown in FIG. 2D. In this step, the backstop portion 33, which is comprised of three panels 33A, 33B, and 33C, is folded up to a vertical position along a fold line 90. Further, the spacer 10 is folded along a fold line 100 so that a portion 101 of the spacer coupled to the backstop portion 33 at the fold line 100 extends rearward in a horizontal direction.

Figure 2E:
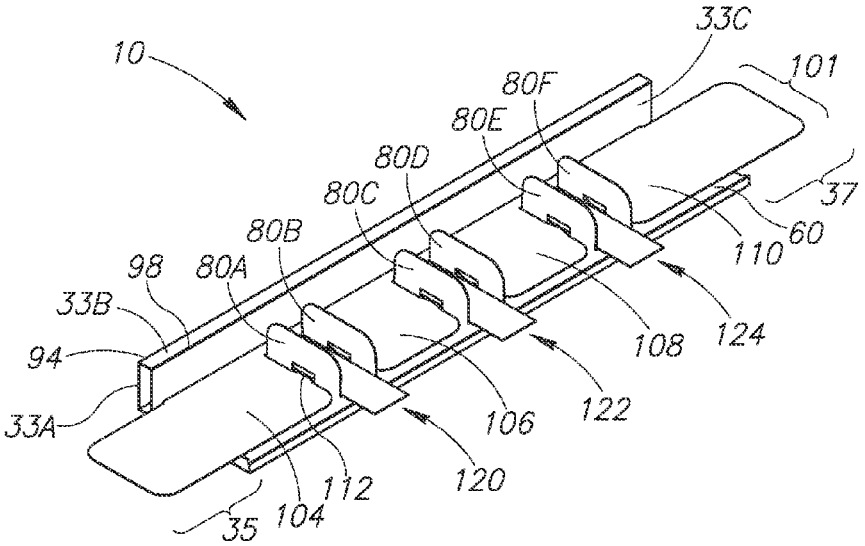

As shown in FIG. 2E, the shape of the backstop portion 33 may be formed by folding the panels 33A, 33B, and 33C along the fold lines 94 and 98. In performing this step, the portion 101 coupled to the backstop portion 33 at the fold line 100 is positioned over the top of panel 60. As shown in FIGS. 2E and 6, the portion 101 includes the left sidewall portion 35 which comprises panels 35A, 35B, 35C, and 35D, and the right sidewall portion 37 which comprises panels 37A, 37B, 37C, and 37D. The portion 101 also comprises panels 104, 106, 108, and 110 each sized to define the bottom surface for the channels 45, 47, 49, and 51, respectively, of the spacer 10. The portion 101 also includes three support tabs 120, 122, and 124 each positioned between a correspondingly located pair of the separation tabs 80A-F. Specifically, the support tab 120 is positioned between the separation tabs 80A and 80B, the support tab 122 is positioned between the separation tabs 80C and 80D, and the support tab 124 is positioned between the separation tabs 80E and 80F. As discussed below, the support tabs 120, 122, and 124 form parts of the separator portions 39, 41, and 43, respectively.

Figure 2F:
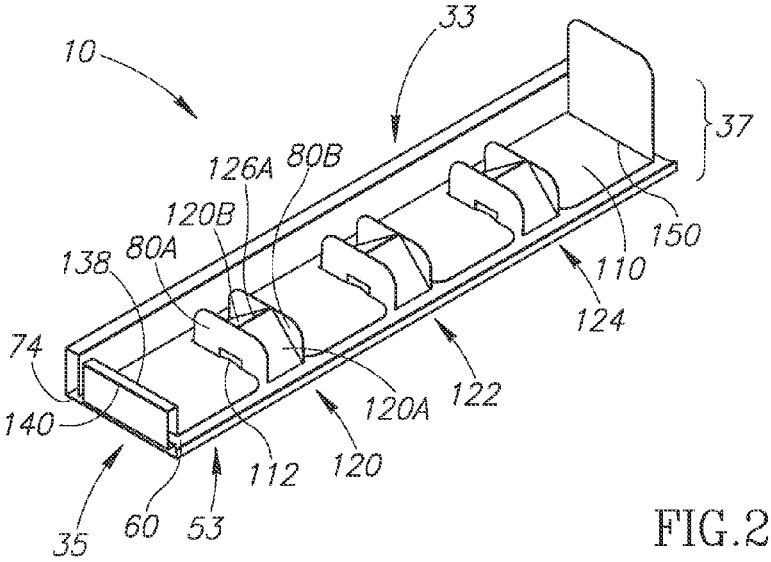

In the next assembly step shown in FIG. 2F, the left sidewall portion 35 is formed by folding the panels 35A, 35B, 35C, and 35D along the fold lines 130, 136, 138, and 140. To maintain the shape of the left sidewall, the panel 35A is advanced horizontally (from left to right) into the base portion 53 under the panel 60 and over the separation tabs panel 74. As can be appreciated, the friction between the panel 35A and the panels 60 and 74 prevents the panel 35A from being easily moved from its assembled position. Alternatively, the panel 35A may be fixedly maintained in its assembled position using a suitable adhesive.

The right sidewall portion 37 is formed by folding the panels 37A, 37B, 37C, and 37D along the fold lines 150, 156, 158, and 160. The right sidewall portion 37 is symmetrical to the left sidewall 35 and is formed by similar folding steps as described above.

The support tab 120 comprises a front portion 120A and a rear portion 120B separated by a fold line 126A. The support tab 120 is coupled to the remainder of the portion 101 at a fold line 128A (see FIG. 6). As shown in FIG. 2F, the rear portion 120B has been folded relative to the portion 101 at the fold line 128A and also folded relative to the front portion 120A at the fold line 126A to form an upwardly projecting "A-frame" shape between the separation tabs 80A and 80B. As discussed above, the separation tabs 80A and 80B are biased slightly inward toward each other due to the width ($W_A$) of the aperture 64A causing a force to be exerted on them. The support tab 120 is positioned between the separation tabs 80A and 80B and functions to provide a counter force to this inward bias so that the separation tabs are fixedly maintained and supported in a vertical position. In this regard, a friction force between the support tab 120 and the separation tabs 80A and 80B helps the support tab 120 to be maintained in its assembled position.

Like the support tab 120, the support tab 122 comprises a front portion 122A and a rear portion 122B separated by a fold line 126B. The support tab 122 is coupled to the remainder of the portion 101 at the fold line 128B. Further, the support tab 124 comprises a front portion 124A and a rear portion 124B separated by a fold line 126C. The support tab 124 is coupled to the remainder of the portion 101 at the fold line 128C. Both of the support tabs 122 and 124 are folded in to an "A-frame" shape (as described above for the support tab 120). The support tab 122 is positioned between the separation tabs 80C and 80D, and the support tab 124 is positioned between the separation tabs 80E and 80F.

Figure 2G:
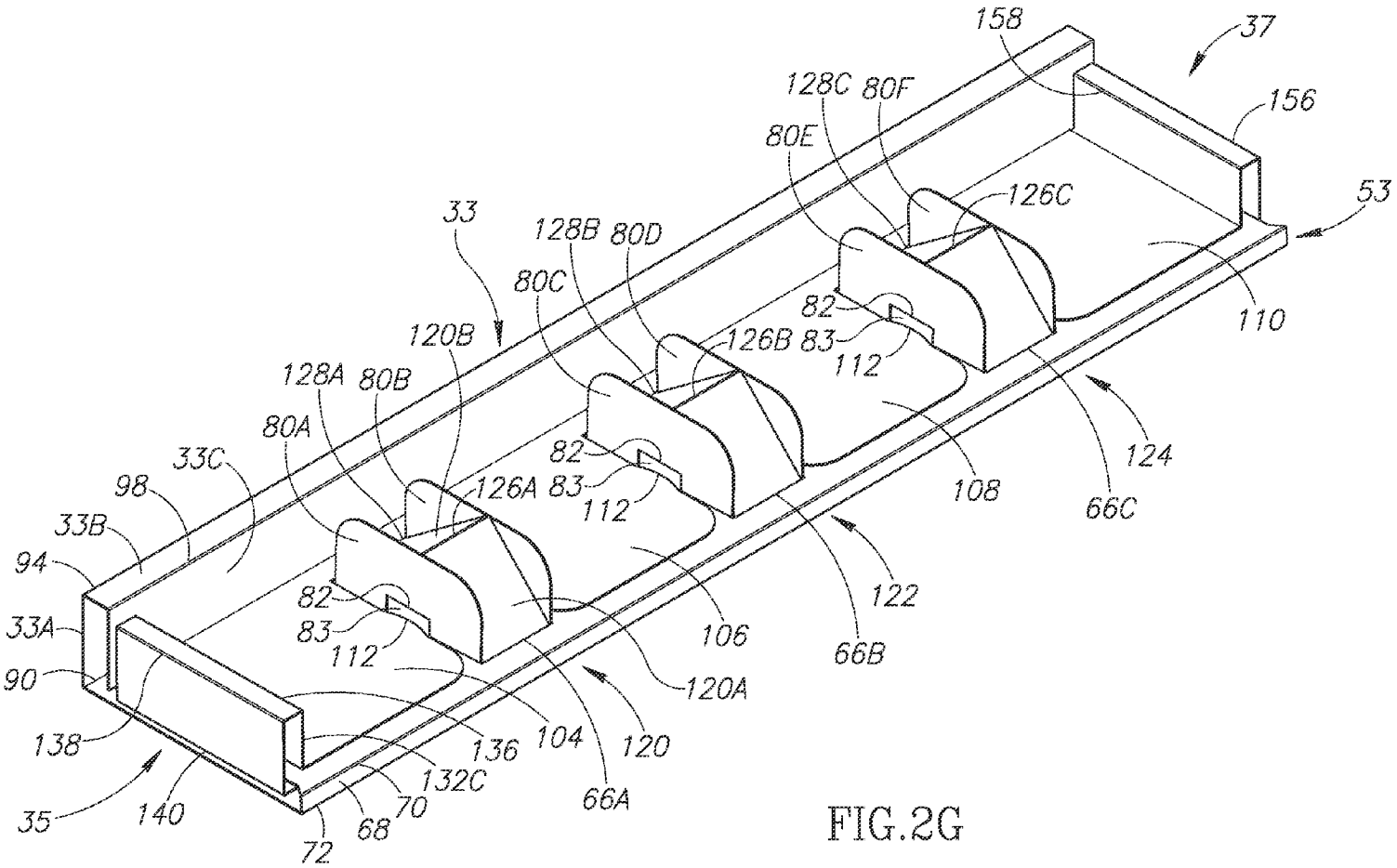

FIG. 2G shows the fully assembled spacer 10. As may best be viewed in FIGS. 2G and 3, a distal potion 120C of the panel 120A of the support tab 120 extends downward through the aperture 64A adjacent a side 66A of the aperture. The distal portion 120C of the panel 120A rests on a top surface of the separation tabs panel 74. Since the support tab 120 naturally tends to slightly resist folding at the fold line 126A, the side 66A of the aperture 64A provides a counter force against the support tab to prevent it from moving upward. In this regard, the support tab 120 functions as a locking mechanism or portion that is automatically "locked" into position once it has been inserted into the aperture 64A without requiring any additional materials such as adhesives. The support tabs 122 and 124 are positioned and function in the same manner as the support tab 120.

As shown in FIGS. 2G and 6, the panel 104 includes on an inward side thereof a tab portion 112 that is sized to have a dimension that is slightly larger than the length of an aperture 83 in the separation tab 80A formed by the cut line 82 (when the tab 80A is folded upward). Thus, when a user positions the panel 104 over the top of the panel 60 (see FIG. 2E), the tab portion 112 is snuggly inserted into the aperture 83 and retained by the friction between the tab portion and the portion of the separation tab 80A that defines the aperture 83. In this regard, the position of the panel 104 is maintained by "locking" the tab portion 112 into the aperture 83. Like the panel 104, the panels 106, 108, and 110 also include tab portions 112 that are each configured to fit snuggly within the aperture 83 of one of the separation tabs 80B-F. The panels 106 and 108 include two tab portions 112 on opposite sides thereof.

FIG. 3 illustrates a left side cross-sectional view of the spacer 10 shown in FIGS. 1 and 2A-2G, taken substantially along the line 3-3 of FIG. 1. In this figure, a beverage container 200 is positioned in the channel 45 on the panel 104. As shown, the panel 104 is slightly graded or sloped such that the beverage container 200 is tilted rearward toward the backstop portion 33. The degree to which the panel 104 is sloped is dependent on the difference in its height between a distal end 105 that rests on the panel 60 and its proximal end (i.e., the portion nearest the cut line 100 that separates the panel 104 from the panel 33C of the backstop 33). For example, if the height of the front panel 68 was increased, the height of the distal end 105 of the panel 104 would also be increased, thereby increasing the slope or grading of the panel 104. Additionally or alternatively, the height of the panel 33C could be increased, which would have the effect of lowering the height of the proximal end (near the cut line 100) of the panel and also increasing the slope. This feature reduces the likelihood that the beverage container 200 will tip forward and out of the channel 45. The angle $\alpha$ at which the beverage container 200 is positioned relative to a horizontal plane is less than 90 degrees (e.g., 85 degrees, 88 degrees, or the like).

As also shown in FIG. 3, the assembled spacer 10 includes a first air cell 212 within the backstop portion 33 and a second air cell 210 within the base portion 53. As can be appreciated, the air cells 210 and 212 may provide additional cushioning and/or insulation for the objects separated and protected by the spacer 10, which can be desirable when shipping or otherwise transporting the objects.

Figure 4B:
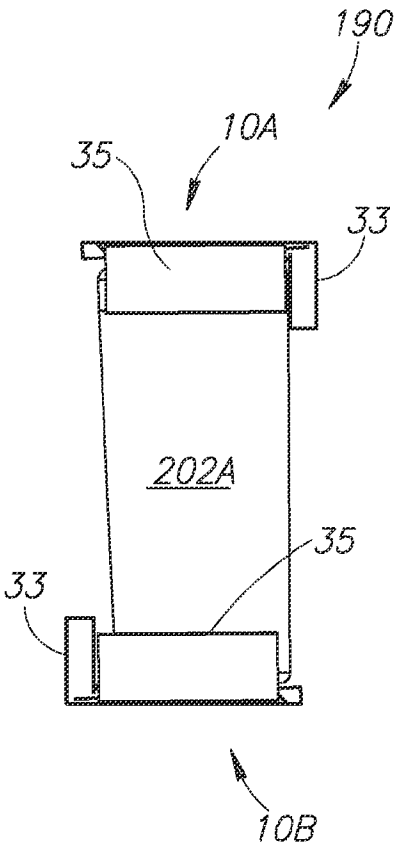
FIG. 4B illustrates a left side elevational view of the friction-lock spacers shown in FIG. 4A.
Figure 4A:
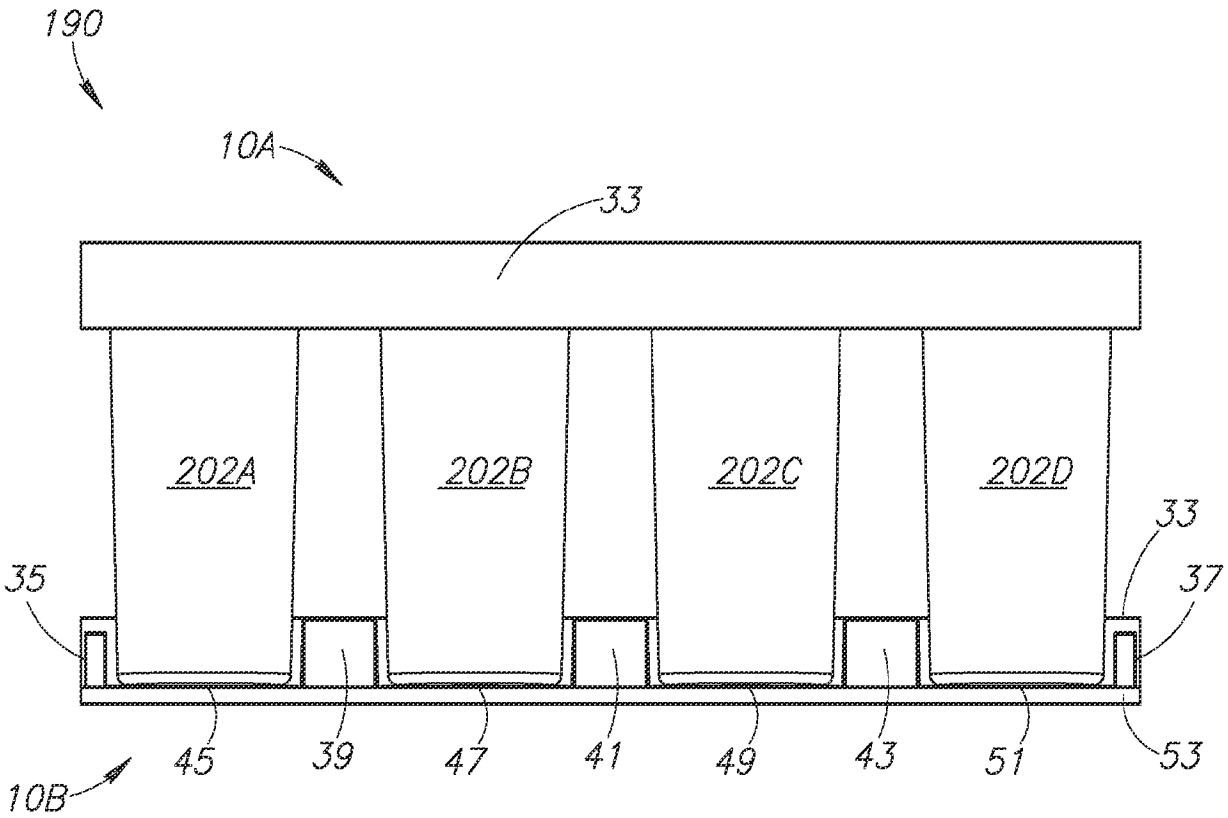
FIG. 4A illustrates a front elevational view of two friction-lock spacers utilized for separating and protecting four beverage containers.
Figure 4C:
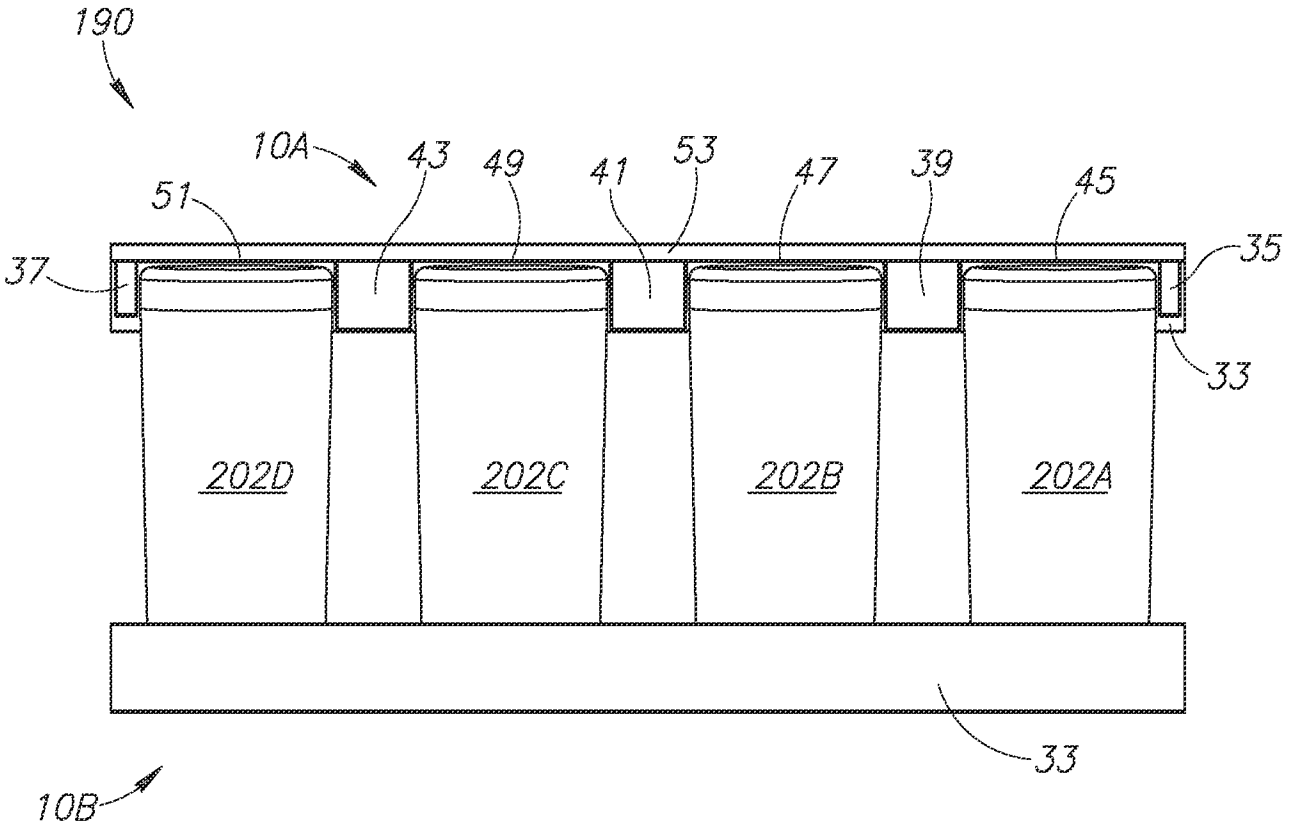
FIG. 4C illustrates a rear elevational view of the friction-lock spacers shown in FIG. 4A.

FIGS. 4A, 4B, and 4C illustrate an assembly 190 wherein two identical spacers 10A and 10B (which are embodiments of the spacer 10 discussed above) are used to separate and protect four beverage containers 202A, 202B, 202C, and 202D. In this example, the bottom portions of each of the containers 202A, 202B, 202C, and 202D are positioned within the channels 45, 47, 49, and 51, respectively, of the bottom spacer 10B. Further, the top portions of each of the containers 202A, 202B, 202C, and 202D are positioned within the channels 45, 47, 49, and 51, respectively, of the top spacer 10A (see FIG. 4C). As shown best in FIG. 4B (left side elevational view), the top spacer 10A is positioned reversed and upside down from the bottom spacer 10B. Thus, in FIG. 4A, which shows the front elevational view, only the backstop 33 of the top spacer 10A is visible. Similarly, in FIG. 4C, which shows the rear elevational view, only the backstop 33 of the bottom spacer 10B is visible.

In the embodiment shown in FIGS. 4A-4C, the spacers 10A and 10B are operative to separate and protect the four beverage containers 202A-D. Once the spacers 10A and 10B are assembled and positioned around the containers 202A-D, the entire assembly 190 may be stored, stacked, combined with other assemblies, or used in conjunction with a display.

Figure 5A:
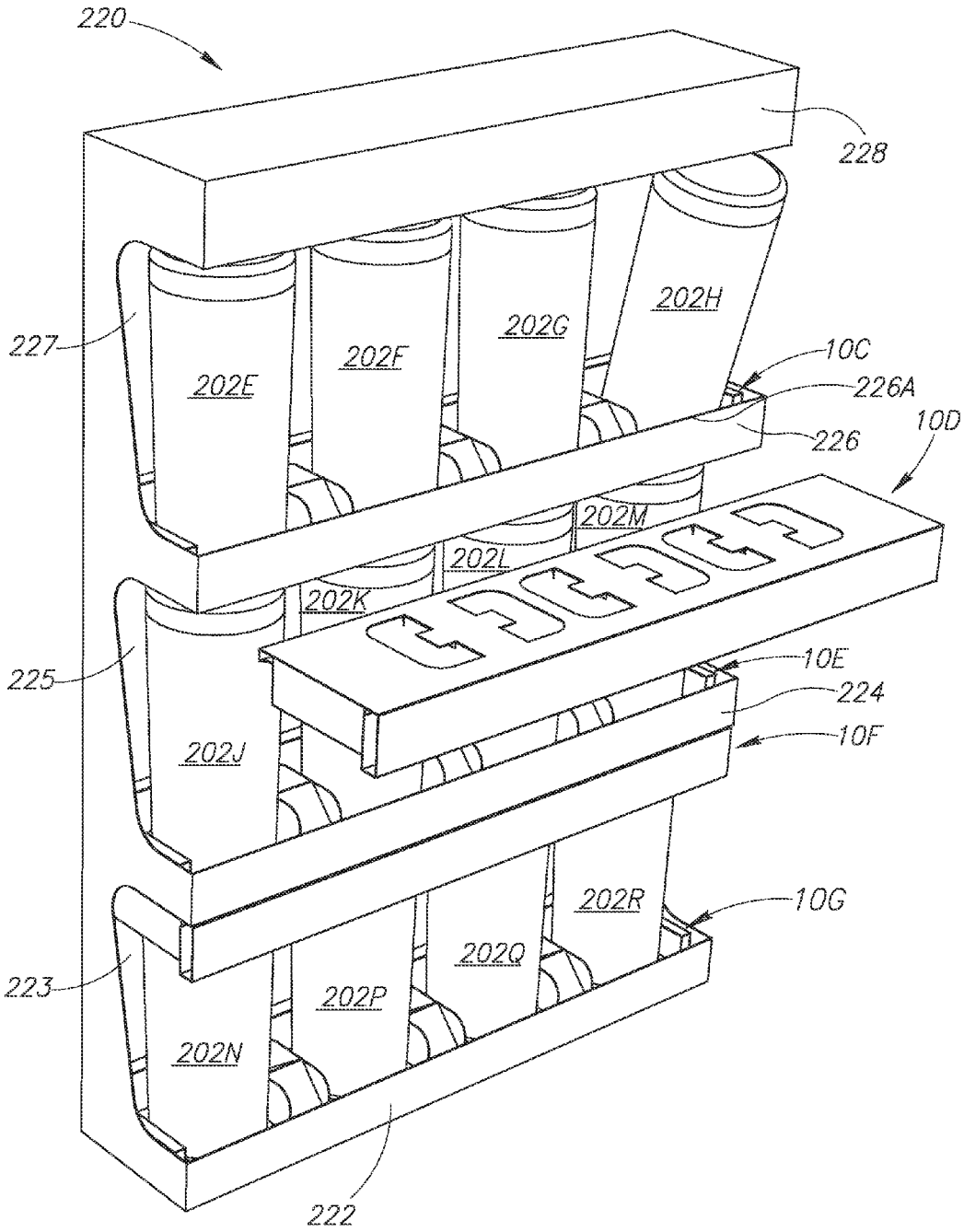
FIG. 5A illustrates a perspective view of a display device that utilizes a plurality of the friction-lock spacers shown in FIG. 1.
Figure 5B:
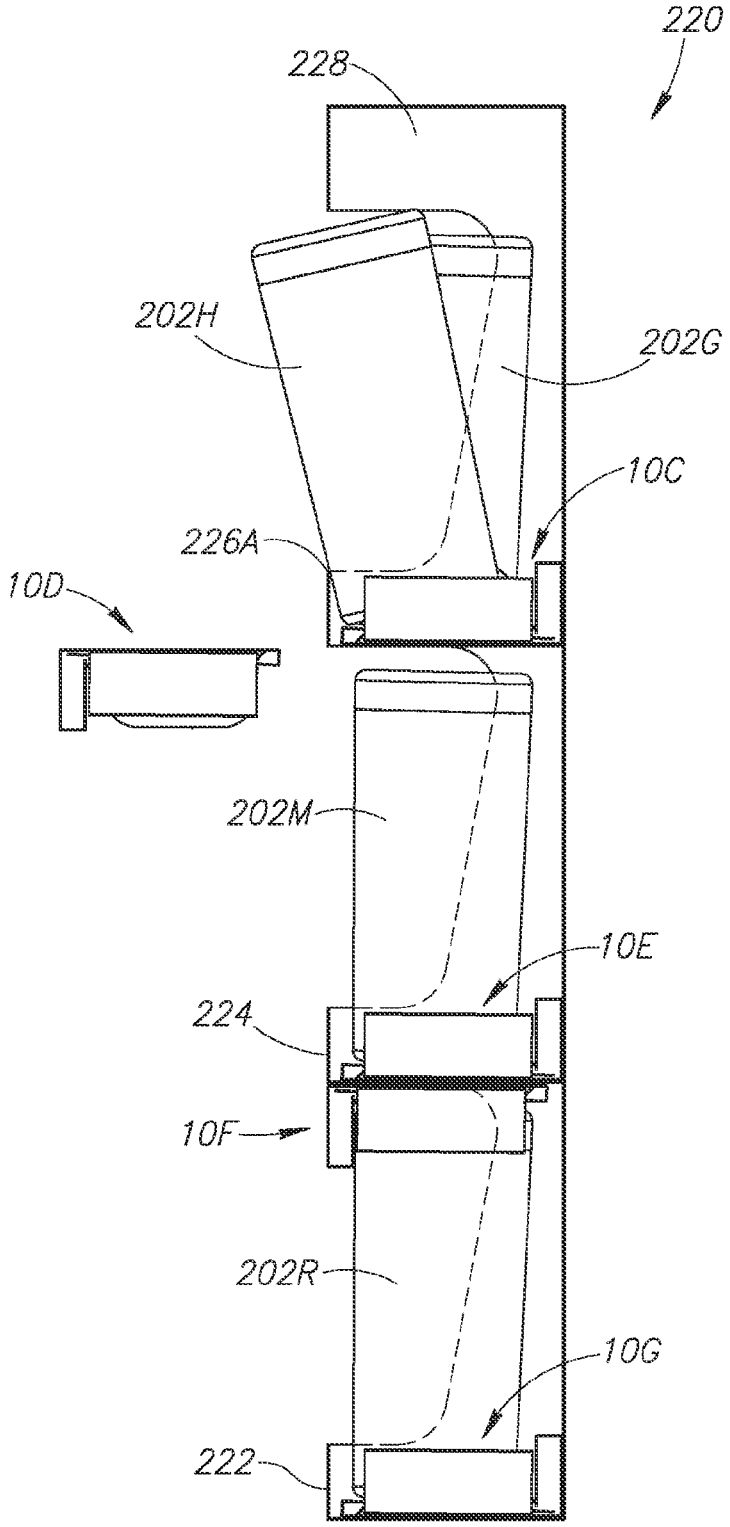
FIG. 5B is a right side elevational view of the display device shown in FIG. 5A.

FIGS. 5A and 5B show an application for the spacer 10 wherein a plurality of spacers 100, 10D, 10E, 10F, and 10G are used in conjunction with a display device 220 to transport, store, and display a plurality of beverage containers 202E-H, 202J-N, and 202P-Q (generally referred to herein as beverage containers 202) arranged in three stacked rows. The beverage containers 202 may be substantially identical, or may differ in one or more respects. The display device 220 comprises a first or bottom shelf 222, a second or middle shelf 224, and a third or top shelf 226. The display device 220 also includes a top portion 228 positioned above the top shelf 226. A first or lower cavity 223 is defined by the shelf 222 on the bottom and by the shelf 224 on the top. A second or middle cavity 225 is defined by the shelf 224 on the bottom and by the shelf 226 on the top. A third or top cavity 227 is defined by the shelf 226 on the bottom and by the top portion 228 on the top.

Each of the shelves 222, 224, and 226 are shaped and sized to receive an assembly similar to the assembly 190 shown in FIGS. 4A-C. For example, the bottom shelf 222 is shown having the beverage containers 202M, 202N, 202P, and 202Q positioned therein and separated by the spacer 10F on the top and the spacer 10G on the bottom. During transport and storage of the display device 220, each of the three shelves 222, 224, and 226 may include four beverage containers and two spacers, as shown for the bottom shelf 222, so that the containers are protected.

Referring to the middle shelf 224 as shown in FIGS. 5A and 5B, the top spacer 10D for the beverage containers 202J, 202K, 202L, and 202M is in the process of being removed by a user from the top of the beverage containers. Advantageously, the backstop 33 may function as a "pull tab" that the user may grasp to pull the spacer 10D forward from the display device 220. As can be appreciated, it may be desirable to remove the top spacer from the beverage containers 202 on each of the shelves 222, 224, and 226 so that the beverage containers may be displayed in and selectively removed from the display device 220. This configuration is shown on the top shelf 226, which includes the four beverage containers 202E, 202F, 202G, and 202H spaced apart on the bottom by the spacer 100, with the top spacer (not shown) having been previously removed. As discussed above with reference to FIG. 3, the spacer 100 is configured to have a graded or sloped base portion 53 that tilts the containers 202 rearward so that they are prevented from tipping out of the front of the display device 220.

As discussed above, the channels 45, 47, 49, and 51 of the spacers 10 are shaped such that the beverage containers may be removed from the front of the spacers 10 without being lifted vertically. This feature is shown in FIGS. 5A and 5B, which shows the beverage container 202H being removed from the spacer 100 by tipping the container forward. As shown, the beverage container 202H need only be lifted vertically over a lip 226A of the top shelf 226 to be removed from the display device 220, such that the spacer 100 does not limit the height requirement for the space above the shelf 226 (i.e., the cavity 227). As can be appreciated, this feature minimizes the height requirement of not only the space above each of the shelves 222, 224, and 226, but also minimizes the height requirement of the overall display device 220.

It should be appreciated that variations of the embodiments shown and described herein may be easily adapted to suit various applications. For example, the spacers may be sized and shaped to separate and protect more or less than four containers or other objects of various shapes and sizes. Further, spacers may integrated into a display device, or used without display devices. Those skilled in the art will readily recognize the wide variety of applications for which the embodiments described herein may be used.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A method of protecting a first object and a second object, the method comprising:

providing first and second spacers each formed from a blank of foldable material cut and scored such that, when formed into an assembled condition by folding, each of the first and second spacers comprises:

a first channel having a base portion and a backstop portion that extends laterally across a rear side of the first channel, the first channel having an unobstructed forwardly open end passageway that allows a portion of the first object to be inserted into the first channel without requiring substantial vertical movement of the first object;

a second channel having a base portion and a backstop portion that extends laterally across a rear side of the second channel, the second channel having an unobstructed forwardly open end passageway that allows a portion of the second object to be inserted into the second channel without requiring substantial vertical movement of the second object;

a first separator portion positioned between the first channel and the second channel, the first separator portion being configured to maintain separation between the first object and the second object; and a lock portion operative to be folded into a position that functions to maintain the assembled condition of the spacer;

positioning a lower portion of the first object within the first channel of the first spacer;

positioning a lower portion of the second object within the second channel of the first spacer;

inverting the second spacer relative to the first spacer;

positioning an upper portion of the first object within the first channel of the inverted second spacer; and positioning an upper portion of the second object within the second channel of the inverted second spacer.

* * * * *